US009052129B2

(12) United States Patent
Faccin

(10) Patent No.: US 9,052,129 B2
(45) Date of Patent: Jun. 9, 2015

(54) CHARGING DEVICE FOR COOLING SYSTEM

(71) Applicant: Luciano Faccin, Varese (IT)

(72) Inventor: Luciano Faccin, Varese (IT)

( * ) Notice: Subject to any disclaimer, the term of this patent is extended or adjusted under 35 U.S.C. 154(b) by 0 days.

(21) Appl. No.: 13/689,343

(22) Filed: Nov. 29, 2012

(65) Prior Publication Data

US 2014/0144170 A1 May 29, 2014

(51) Int. Cl.
*F25B 45/00* (2006.01)

(52) U.S. Cl.
CPC ..... *F25B 45/00* (2013.01); *F25B 2345/001* (2013.01); *F25B 2345/003* (2013.01)

(58) Field of Classification Search
CPC ..... F25B 45/00; F25B 2345/003; F25B 2345/001
USPC ..... 62/149, 292, 129, 157
See application file for complete search history.

(56) References Cited

U.S. PATENT DOCUMENTS 5,146,761 A * 9/1992 Cavanaugh et al. ..... 62/149
5,369,959 A * 12/1994 Pfefferle et al. ..... 62/195
5,410,908 A * 5/1995 Erichsen ..... 73/31.05
5,412,955 A * 5/1995 Husarik et al. ..... 62/85
5,467,608 A * 11/1995 Cording et al. ..... 62/195
5,533,359 A * 7/1996 Muston et al. ..... 62/292
5,560,215 A * 10/1996 Talarico ..... 62/149
5,592,826 A * 1/1997 Sagar et al. ..... 62/195
5,806,328 A * 9/1998 Muston et al. ..... 62/149
6,247,325 B1 * 6/2001 Muston et al. ..... 62/292
6,637,229 B1 * 10/2003 Forrest et al. ..... 62/230
6,681,764 B1 * 1/2004 Honkonen et al. ..... 128/201.21
7,086,237 B2 * 8/2006 Arshansky et al. ..... 62/77
2005/0204756 A1 * 9/2005 Dobmeier et al. ..... 62/149
2005/0247070 A1 * 11/2005 Arshansky et al. ..... 62/77
2007/0255362 A1 * 11/2007 Levinson et al. ..... 607/96
2008/0098764 A1 * 5/2008 Faccin et al. ..... 62/292
2009/0107159 A1 * 4/2009 Mann et al. ..... 62/239
2010/0023171 A1 * 1/2010 Bittner et al. ..... 700/282
2011/0062703 A1 * 3/2011 Lopez et al. ..... 285/129.1
2012/0206364 A1 * 8/2012 Ciesla et al. ..... 345/168
2012/0262881 A1 * 10/2012 Onimaru et al. ..... 361/701

* cited by examiner

*Primary Examiner* — Mohammad M Ali
(74) *Attorney, Agent, or Firm* — R. Ruschena Patent Agent, LLC

(57) ABSTRACT

A charging device (1) of a cooling system comprising a coolant fluid; said charging device (1) comprises a supply system (2) suitable to place a reservoir (10) of coolant fluid in fluidic connection with the cooling system; said charging device (1) comprises measurement means (3) of the coolant fluid, comprising a pressure sensor (3*a*) suitable to measure the pressure of the coolant fluid in the cooling system and a thermometer (3*b*) suitable to measure the temperature of the coolant fluid in the cooling system; a connection means (4) suitable to functionally and simultaneously connect the supply system (2) and the measurement means (3) to the cooling system; and a control unit (5) suitable to measure at least the quantity of coolant fluid present in the cooling system as a function of said temperature and said pressure.

6 Claims, 2 Drawing Sheets

CHARGING DEVICE FOR COOLING SYSTEM

BACKGROUND OF THE INVENTION

1. Field of the Invention

The present invention relates to a charging device for a cooling system of the type specified in the preamble of the first claim.

In particular, the present invention relates to a device that is suitable to enable an operator to introduce a coolant fluid into a cooling system such as, for example, those present in refrigerators, air conditioners for buildings and vehicles or other cooling systems.

2. Brief Description of the Prior Art

As is known, the operations to charge a cooling system are performed during both the installation phase and the maintenance phase.

In the first case, the operator initially creates a vacuum inside the circuit and then introduces the coolant fluid into the cooling circuit through a suitable connector.

In the second case, the operator determines the quantity of coolant dispersed by the cooling system and in relation thereto tops up the coolant fluid.

In particular, said operation requires that a manometer be connected to the cooling system connector and the pressure of the coolant fluid be measured.

Subsequently, the operator connects a vacuum pump to the connector so as to eliminate the fluids present in the cooling system and, lastly, disconnects the manometer and vacuum pump, connecting in their place a pressurized container of coolant fluid so as to recharge the cooling system.

When recharging is complete, the operator disconnects the canister from the cooling system and connects the manometer to measure the cooling system pressure once again.

If the pressure is at the desired level, the operation completes, otherwise the pressurized container needs to be connected to the cooling system, more fluid inserted and the cooling system pressure verified once again.

The prior art method mentioned above has several significant drawbacks.

A first drawback is the fact that the operator is unable to accurately assess the status of the cooling system and therefore maintenance cannot be performed in the very best way.

As a result, in order to prevent malfunctioning of the cooling system, the operator often chooses, regardless of the cooling system status, to empty the cooling system and recharge it, with consequent wastage of coolant and increased maintenance costs. The operator thus generally chooses to introduce a fixed quantity of coolant fluid en masse.

Another drawback is the fact that with the prior art devices, it is almost impossible to monitor filling of the cooling system.

As a result, at the end of each procedure, the correct filling of the cooling system needs to be verified and filling often has to be completed by repeating the procedure, thus determining an increase in costs and in the time needed to complete the operations.

One significant drawback is therefore the fact that the procedure, especially in the case of maintenance, is particularly complex and lengthy.

In fact, to perform such adjustment various tools need to be used: a vacuum pump, a manometer, a pressurized container, various pipes for connecting the container and a set of scales.

SUMMARY OF THE INVENTION

In this situation, the technical purpose of the present invention is to devise a charging device of a cooling system able to substantially overcome the drawbacks mentioned above.

Within the sphere of said technical purpose, one important aim of the invention is to obtain a cooling system charging device which permits simple and fast charging of the cooling system.

Another important aim of the invention is to have a charging device which, by implementing a single procedure, allows maintenance operations to be performed in a particularly accurate and efficient manner.

In particular, one important aim of the invention is therefore to devise a charging device which makes it possible to accurately determine the quantity of coolant fluid to be introduced into the cooling system.

The last, but not least important aim of the invention, is to develop a charging device of a cooling system able to reduce the costs and the time needed to perform this operation.

The technical purpose and specified aims are achieved by a charging device of a cooling system as claimed in the appended claim 1.

The charging device of a cooling system comprises a supply system suitable for placing at least one reservoir of coolant fluid in fluidic connection with the cooling system; measurement means of said coolant fluid comprising a pressure sensor suitable for measuring the pressure of the coolant fluid present in the cooling system and a thermometer suitable for measuring the temperature of the coolant fluid present in the cooling system; and a connector body suitable for simultaneously and functionally connecting the supply system to the measurement means of the cooling system; and a control unit suitable for measuring the quantity of coolant fluid present in the cooling system as a function of the temperature and the pressure.

Preferred embodiments of the charging device, described in brief above, are defined in the dependent claims.

BRIEF DESCRIPTION OF THE DRAWINGS

The characteristics and advantages of the invention are clearly evident from the detailed description below of a preferred embodiment thereof, with reference to the accompanying drawings, in which.

DETAILED DESCRIPTION OF THE INVENTION

Figure 1:
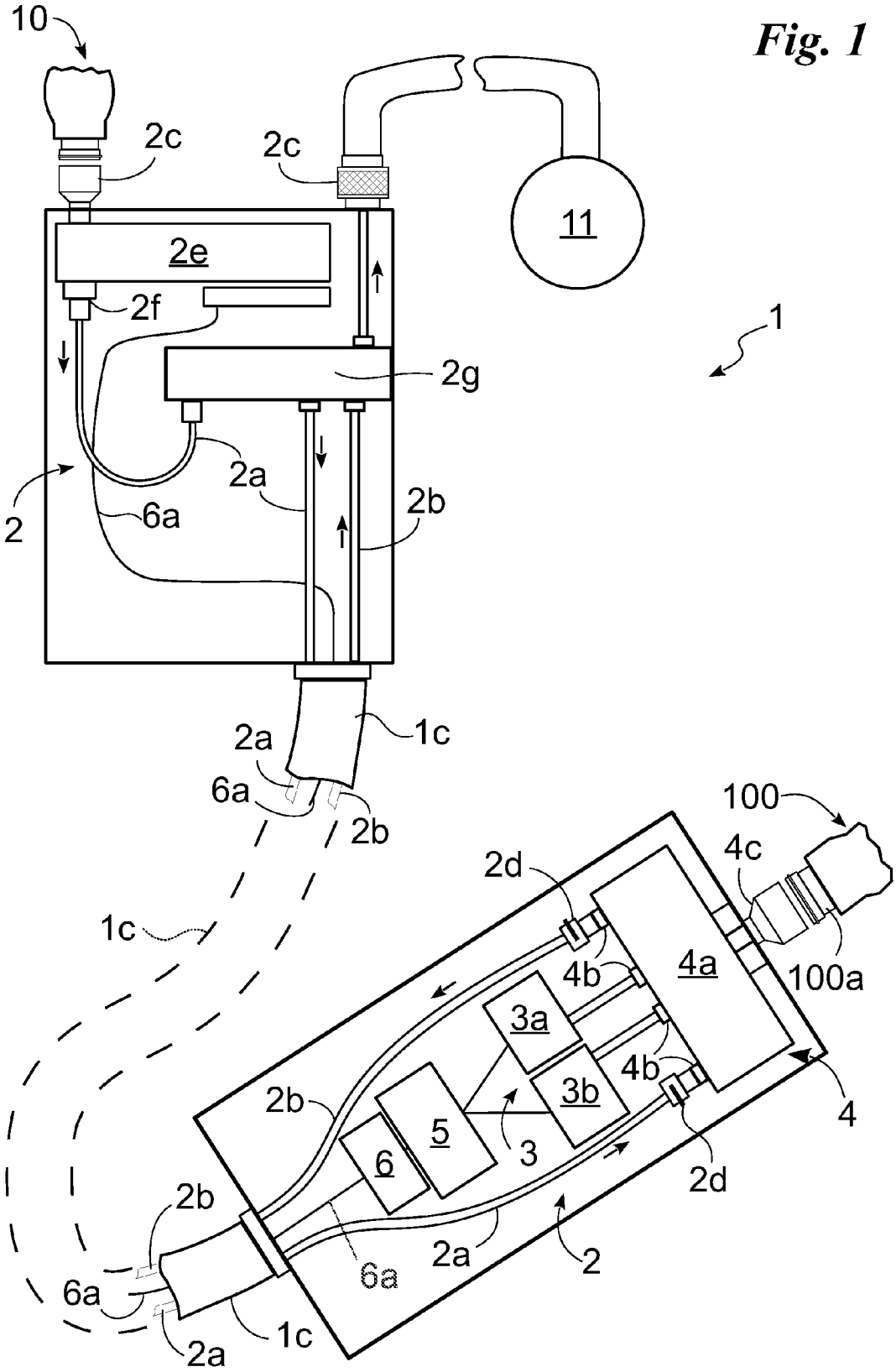
FIG. 1 shows the charging device in cross-section.
Figure 2:
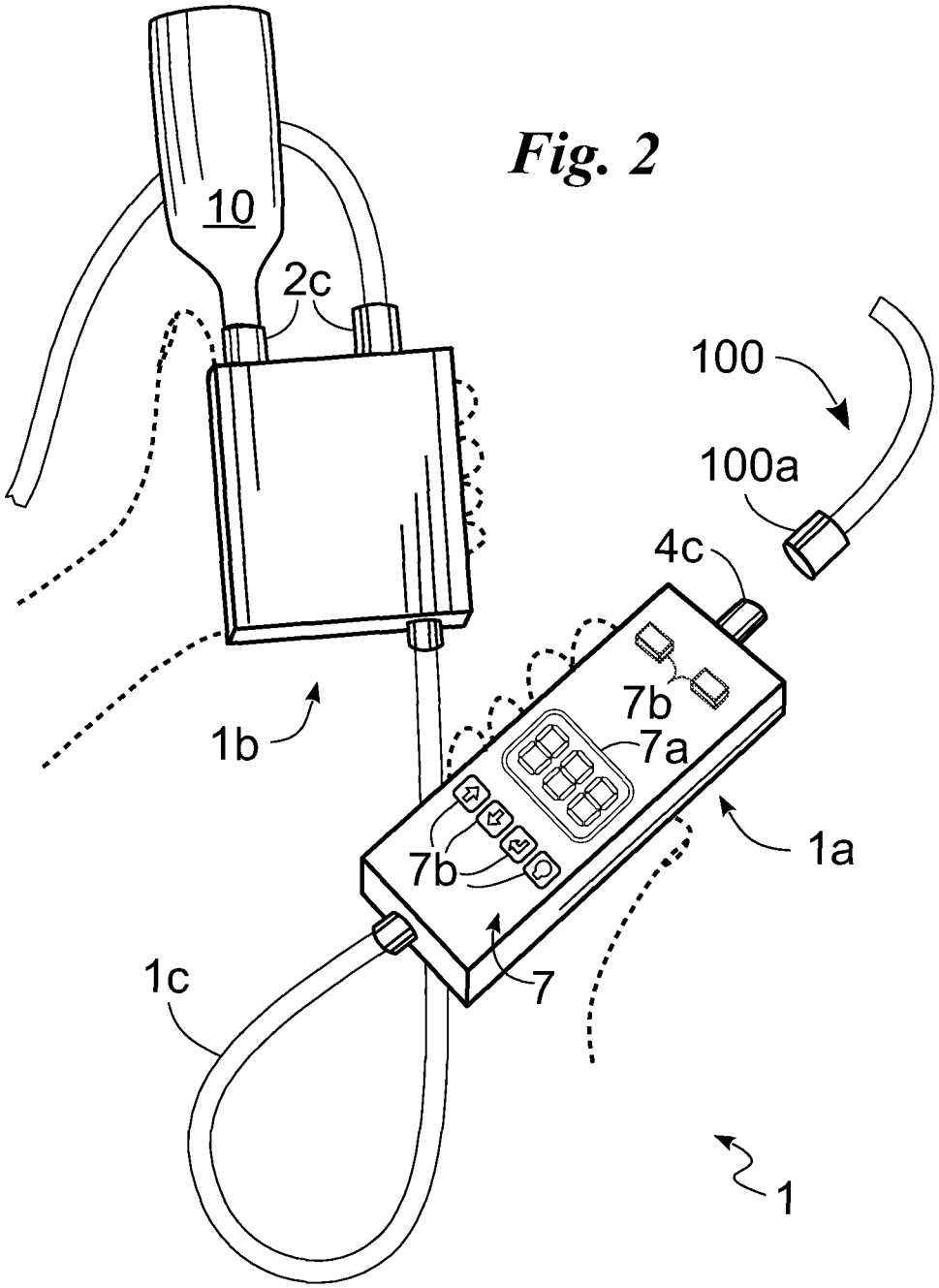
FIG. 2 shows a charging device of a cooling system according to the invention.

With reference to said drawings, reference numeral 1 globally denotes a cooling system charging device according to the invention.

It is suitable to be used to charge a cooling system such as for example those in refrigerators, air conditioners for buildings and vehicles or other similar cooling systems.

In particular, the charging device 1 is suitable for varying the quantity of coolant fluid present inside a cooling circuit 100 forming part of the cooling system and, therefore, comprises a dedicated access valve **100*a* suitable to permit the connection of the cooling circuit 100 to the charging device 1**.

The charging device 1 primarily comprises a supply system 2 suitable to place a reservoir 10, containing appropriately pressurized coolant fluid, in fluidic connection with the charging device 1 and, in particular, with the cooling circuit 100; measurement means 3 of the coolant fluid; connection means 4 suitable to functionally and simultaneously connect the supply system 2 and the measurement means 3 to the cooling system and, more specifically, to the cooling circuit 100; a control unit 5 suitable to interact at least with the measurement means 3; a battery 6 connected by cables **6*a*, to the electronic components of the charging device 1 so as to power them; and interface devices 7 suitable to permit an exchange of data between an operator and the control unit 5**.

In particular, the interface devices 7 comprise passive interface devices 7*a*, such as a screen, suitable to permit the control unit 5 to display data relating to the charging device 1 or to the cooling circuit 100 for the operator; and active interface devices 7*b*, such as keys, by means of which the operator controls the supply system 2 and/or provides the control unit 5 with data needed for the functioning of the charging device 1 such as, for example, the type of coolant fluid present in the circuit 100.

Alternatively, said interface devices 7 comprise a touch screen or other similar device suitable to perform the function of both passive interface and active interface.

The connection means 4 comprise a connector recipient 4*a* defining an opportunely sealed interchange space functionally positioned between the circuit 100 and the measurement means 3 and the supply system 2; one or more internal connectors 4*b* suitable to place said space in fluidic connection with the measurement means 3 and the supply system 2; and at least one outer connector 4*c* suitable to engage, preferably by means of a threaded coupling, with the access valve 100*a* and to place the circuit 100 in fluidic connection with the interchange space.

The supply system 2 comprises at least one duct and, in particular, at least one charging duct 2*a* and at least one drainage duct 2*b*, respectively suitable to convey the coolant fluid to the cooling circuit 100 and to empty it from said circuit 100; at least two attachments 2*c* suitable to connect the reservoir 10 to the charging duct 2*a* and a vacuum pump 11 or other apparatus suitable to empty the coolant fluid from the cooling circuit 100, to the drainage duct 2*b*. The supply system 2 comprises, in addition to the aforesaid components, a control valve 2*d* suitable to alternatively control the opening and closing of the ducts 2*a* and 2*b*; a set of scales 2*e* suitable to measure the quantity of coolant fluid present in the reservoir 10; a check valve 2*f* placed between the charging duct 2*a* and the reservoir 10; and a distribution valve 2*g* connected to the ducts 2*a* and 2*b* and suitable to support said ducts 2*a* and 2*b*.

In particular, the control valves 2*d*, directly controlled by the active interface devices 7*b*, are functionally positioned between the internal connectors 4*b* and the ducts 2*a* and 2*b* so as to regulate the exit and entrance of the coolant fluid from the interchange space and therefore from the cooling circuit 100.

The charging device 1 has measurement means 3 appropriately connected to the connector recipient 4*a*.

Said measurement means 3 advantageously comprise a pressure sensor 3*a* and a thermometer 3*b* which by respectively measuring the pressure and temperature of the coolant fluid contained in the interchange space, measure the pressure and the temperature of the coolant fluid present in the cooling circuit 100 and, as a result, in the cooling system.

Preferably, the pressure sensor 3*a* and the thermometer 3*b* are of the electronic type.

More preferably, the pressure sensor is of the piezoresistive type suitable to measure the pressure and convert it into an electric signal proportional to said pressure.

Functionally connected to the measurement means 3, the charging device 1 appropriately comprises the control unit 5 suitable to measure the quantity of fluid present in the cooling circuit 100, as a function of the temperature and pressure measured by the means 3.

The control unit 5 comprises an electronic circuit board or other similar electronic device which, by using as input data at least the signals of the measurement means 3, is advantageously able to determine the quantity of coolant fluid present in the cooling circuit 100. Preferably, it determines the quantity of coolant fluid present in the circuit 100 as a function of the temperature, pressure and type of coolant fluid, indicated by the operator by means of the active interface devices 7*b*.

In conclusion the control unit 5 determines, according to the temperature, pressure and type of coolant fluid, the quantity of coolant fluid to introduce into the cooling circuit 100 and, as a result, regulates the flow of coolant fluid into and out of the circuit 100 by opening or closing the control valves 2*d*.

To such purpose, the control unit 5 may also be connected to the scales 2*e* so as to know in real time the content of coolant fluid in the reservoir 10 and, as a result, that introduced into the circuit 100. However the connection to the scales is not essential given that the control unit 5 is, in any case, able to determine whether the amount of fluid in the circuit 100 is correct or not. Said scales 2*e* may therefore be used by operators for whom the use of said scales 2*e* is part of their standard practice.

Lastly, the charging device 1 comprises at least one hand-held unit, that is to say a unit suitable to substantially internally house the components listed above and having dimensions such as to be held and handled manually and more specifically, using a single hand.

Preferably, the charging device 1 has a first hand-held unit 1*a* and a second hand-held unit 1*b*.

The first hand-held unit 1*a* comprises, substantially internally, the measurement means 3, the connection means 4, the control unit 5, the battery 6, the interface device 7, the control valves 2*d*, and part of the ducts 2*a* and 2*b*.

The second hand-held unit 1*b* comprises, substantially internally, the remaining components of the supply system 2. In particular, it comprises a portion of the ducts 2*a* and 2*b*, the attachments 2*c*, the check valve 2*f*, and the distribution valve 2*g*.

The hand-held units 1*a* and 1*b* are reciprocally connected by a connection cable 1*c*, preferably a flexible cable, suitable to internally house part of the ducts 2*a* and 2*b* and part of the cables 6*a*.

The functioning of the charging device 1 of a cooling system, described above in a structural sense, is as follows.

First of all, the charging device 1 is connected, by means of the attachments 2*c*, to the reservoir 10 and to the vacuum pump 11 and the control valves are closed preventing the passage of fluid between the connectors 2*a* and 2*b* and the connector recipient 4*a*. In this way the interchange space remains isolated.

The operator fits the charging device 1 to the cooing circuit 100 using the outer connector 4*c* so that the coolant fluid present in the circuit 100 fills the interchange space.

At this point the operator holds the first hand-held unit 1*a* in one hand, while the second is attached to the vacuum pump, generally positioned on the floor, by means of a suitable bracket, and signals to the control unit 5 the type of coolant fluid present in the circuit 100 using the active interface devices 7*b*. Substantially simultaneously, the pressure sensor 3*a* and the thermometer 3*b* measure the pressure and temperature of the fluid present in the interchange space, that is to say, in the circuit 100, and send said data to the control unit 5.

On the basis of the aforesaid data (temperature, pressure, type of gas), the control unit 5 determines the quantity of gas present in the circuit and, as a result, the quantity of fluid, if any, to be added to restore the correct functioning of the cooling system.

The operator reads this information on the passive interface devices 7*a* and decides whether to add coolant fluid or if the cooling system needs to be emptied entirely and refilled completely with new coolant fluid.

In the first case, the operator, using the active interface devices 7*b*, opens the control valves 2*d*, placing the reservoir 10 in fluidic connection with the interchange volume and thereby, the cooling system 100.

Specifically, thanks to the presence of the scales 2*e*, the operator can see, on the passive interface devices 7*a* and in real time, the quantity of coolant fluid introduced into the cooling circuit 100 and, once the desired quantity has been introduced, close the connection between the reservoir 10 and the cooling circuit 100 by closing the corresponding valves 2*d*.

At this point the pressure sensor 3*a* and the thermometer 3*b* measure the new pressure and temperature values of the fluid in the circuit 100, the control unit 5 recalculates the quantity of gas present in the circuit enabling the operator to verify the correct filling of the circuit 100.

In particular, if the quantity of fluid present in the circuit 100 is as desired, the operator disconnects the charging device 1 from the circuit 100; if that is not the case, the quantity of fluid can be further modified.

In particular, in this latter case, depending on whether there is more or less fluid in the circuit than desired, the operator controls the establishment of the fluidic connection of the circuit 100 with the reservoir 10 or the vacuum pump 11 so as to bring the quantity of fluid present in the circuit to the desired value. Conversely, should the operator decide that the cooling system needs to be completely emptied, this can be done using a specific previously connected recovery device, which comprises a vacuum pump and liquid recovery means. Such device may be connected to the attachment 2*c* by means of a T-connector even in combination with the vacuum pump which is not normally suitable to recover liquids.

Once the pressure measured by the pressure sensor 3*a* is substantially equal to zero, the control unit 5 signals the complete emptying of the circuit 100 to the operator via the passive interface devices 7*a*.

The operator sends the command to close/open the control valves 2*d* and, then, to interrupt the connection between the vacuum pump 11 and circuit 100 permitting the activation of the connection between the reservoir 10 and cooling circuit 100 so that the coolant fluid begins to flow into the cooling system.

The invention permits significant advantages.

A first important advantage lies in the fact that the charging device 1 makes it possible to optimise the filling and, in particular, the maintenance of the cooling system.

This advantage is due to the fact that the control unit 5, thanks to the presence of the pressure sensor 3*b* and of the thermometer 3*a*, determines, in a particularly accurate manner, the quantity of fluid present in the circuit and, thus, how much coolant fluid to introduce into the device.

One important advantage lies in the fact that, while the prior art devices could only work with canisters of a limited capacity and specifically with a maximum capacity of 2 kg, by monitoring the quantity of fluid, the charging device 1 can be used with reservoirs having a much greater capacity.

Another advantage lies in the fact that the operator is able to accurately assess the state of the cooling system (not enough gas, too much gas, problems with the cooling system), and can therefore select the best maintenance procedure and thereby minimise costs and times without having to disconnect the cooling system.

Another important advantage lies in the fact that the procedure obtained thanks to the charging device 1 is simple and fast.

Such aspect is moreover incremented by the fact that the charging device 1 is composed of a single hand-held unit on which all the data can be read directly at the point of connection to the cooling system, so that all operations are performed online without ever disconnecting.

In particular, such aspect has been possible thanks to the use of a pressure sensor 3*a* which, being of the piezoresistive type, is characterised by reduced dimensions as well as extreme accuracy of measurement and therefore suitable for permitting the construction of a charging device 1 of reduced dimensions.

The invention may be modified or varied while remaining within the sphere of the inventive concept. All the elements described and claimed may be replaced by equivalent elements and the parts, materials, shapes and dimensions may be chosen as needed.

The invention claimed is:

1. A charging device (1) of a cooling system comprising a coolant fluid; said charging device (1) comprising:

a supply system (2) suitable to place at least one reservoir (10) of said coolant fluid in fluidic connection with said cooling system;

measurement means (3) of said coolant fluid, comprising a pressure sensor (3*a*) suitable to measure the pressure of said coolant fluid in said cooling system and a thermometer (3*b*) suitable to measure the temperature of said coolant fluid in said cooling system;

a control unit (5) suitable to measure at least the quantity of said coolant fluid present in said cooling system as a function of said temperature and said pressure;

an interface devices (7) suitable to exchange data between said control unit (5) and an operator and comprising an active interface devices (7*b*), suitable for permitting the operator to signal the type of said coolant fluid to said control unit (5);

connection means (4) suitable to functionally simultaneously connect said supply system (2) and said measurement means (3) to said cooling system;

said supply system (2) comprising:

at least one charging duct (2*a*) and at least one drainage duct (2*b*), respectively suitable to convey the coolant fluid to said cooling system and to empty it;

at least two attachments (2*c*) suitable to connect said reservoir (10) respectively to said charging duct (2*a*) and to a vacuum pump (11);

control valves (2*d*);

a scale (2*e*) suitable to measure the quantity of coolant fluid present in said reservoir (10);

said charging device (1) structurally comprising:

a first hand-held unit (1*a*) comprising:

said measurement means (3) of said coolant fluid;

said connection means (4);

said control unit (5);

a battery (6);

said interface device (7);

said control valves (2*d*);

and part of said ducts (2*a*, 2*b*);

a second hand-held unit (1*b*) comprising:

a portion of said ducts (2*a*, 2*b*);

said attachments (2*c*);

said scale (2*e*);

a flexible connection cable (1*c*) connecting said first hand-held units (1*a*) and said second hand-held unit (1*b*), internally housing part of the ducts (2*a*, 2*b*) and cables (6*a*).

2. The charging device (1) as claimed in claim 1, wherein said pressure sensor (3*a*) is of the piezoresistive type.

3. The charging device (1) as claimed in claim 1, wherein said set of scales (2*e*) suitable to measure the quantity of said coolant fluid in said reservoir (10).

4. The charging device (1) as claimed in claim 1, wherein said control unit (5) is placed in connection with said supply system (2) so as to measure the variation in quantity of said coolant fluid in said reservoir (10).

5. The charging device (1) as claimed in claim 1, wherein said supply system (2) comprises at least one charging duct (2*a*) suitable to convey said coolant fluid to said cooling system; and at least one drainage duct (2*b*) suitable to empty said coolant fluid from said cooling system and evacuate it from said circuit (100); at least two attachments (2*c*) suitable to connect the reservoir (10) to the charging duct 12*a*1 and a vacuum pump (11) or other apparatus suitable to empty the coolant fluid from the cooling circuit (100), to the drainage duct (2*b*).

6. The charging device (1) as claimed in claim 5, wherein said supply system (2) comprises control valves (2*d*) suitable to alternatively command the opening and closing of said ducts (2*a*, 2*b*).

* * * * *